US008015662B2

(12) United States Patent
Rosenzweig et al.

(10) Patent No.: US 8,015,662 B2
(45) Date of Patent: Sep. 13, 2011

(54) CLEANING DEVICE

(75) Inventors: Max Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 444 days.

(21) Appl. No.: 12/335,140

(22) Filed: Dec. 15, 2008

(65) Prior Publication Data

US 2010/0050369 A1 Mar. 4, 2010

Related U.S. Application Data

(60) Provisional application No. 61/092,237, filed on Aug. 27, 2008.

(51) Int. Cl.

| | |
|---|---|
| ***A47L 5/00*** | (2006.01) |
| ***A47L 9/04*** | (2006.01) |
| ***A47L 9/06*** | (2006.01) |
| ***A47L 5/10*** | (2006.01) |
| ***A47L 5/26*** | (2006.01) |

(52) U.S. Cl. ..... 15/373; 15/368; 15/398

(58) Field of Classification Search ..... 15/368, 15/373, 393, 398

See application file for complete search history.

(56) References Cited

U.S. PATENT DOCUMENTS

| | | | |
|---|---|---|---|
| 2,674,002 | A | 4/1954 | White |
| 2,892,201 | A | 6/1959 | Peterson at al. |
| 3,259,934 | A | 7/1966 | Leinfelt |
| 3,651,536 | A | 3/1972 | Bolzon, Jr. et al. |
| D317,678 | S | 6/1991 | Butcher et al. |
| 5,347,679 | A | 9/1994 | Saunders et al. |

(Continued)

FOREIGN PATENT DOCUMENTS

| | | |
|---|---|---|
| CA | 2087056 | 7/1994 |

(Continued)

OTHER PUBLICATIONS

International Search Report, Application No. PCT/US09/31838, dated Apr. 17, 2009.

(Continued)

*Primary Examiner* — Bryan R Muller

(74) *Attorney, Agent, or Firm* — Wolf, Greenfield & Sacks, P.C.

(57) ABSTRACT

A cleaning device is provided. The cleaning device may include a handle, an activation mechanism moveable between a first position and a second position by a user of the device, a hollow member having a suction opening at an end of the hollow member, an electrically powered motor configured to produce suction at the suction opening, and a bristle support member pivotable relative to the hollow member. The bristle support member may include a plurality of bristles attached thereto. The bristle support member may be operatively coupled to the activation mechanism. When the activation mechanism is in the first position, the bristle support member may be in a closed position adjacent to the suction opening of the hollow member and the plurality of bristles may be positioned to perform a sweeping function. When the activation mechanism is moved to the second position, the bristle support member may be pivoted away from the suction opening of the hollow member to an open position to provide access to the suction opening.

16 Claims, 13 Drawing Sheets

U.S. PATENT DOCUMENTS

| | | | | | |
|---|---|---|---|---|---|
| 5,432,976 | A | | 7/1995 | Alazet | |
| 5,446,943 | A | | 9/1995 | Sovis et al. | |
| 5,475,893 | A | | 12/1995 | Sepke | |
| D370,322 | S | | 5/1996 | Canni Ferrari | |
| 5,555,599 | A | * | 9/1996 | Markley | 15/322 |
| 5,606,770 | A | | 3/1997 | Sovis et al. | |
| 5,617,610 | A | * | 4/1997 | Dearaujo | 15/328 |
| 5,638,572 | A | | 6/1997 | Canni Ferrari | |
| D383,578 | S | | 9/1997 | Ho | |
| D384,506 | S | | 10/1997 | Canni Ferrari | |
| 5,722,112 | A | | 3/1998 | Scanni et al. | |
| 5,839,158 | A | | 11/1998 | Schupp et al. | |
| 5,850,669 | A | | 12/1998 | Schupp et al. | |
| D406,420 | S | | 3/1999 | Sin | |
| D420,774 | S | | 2/2000 | Schupp | |
| 6,029,311 | A | * | 2/2000 | Scanni et al. | 15/344 |
| D424,263 | S | | 5/2000 | Canni Ferrari et al. | |
| 6,125,500 | A | | 10/2000 | Kat | |
| D548,911 | S | | 8/2007 | Main et al. | |
| 7,320,150 | B2 | | 1/2008 | Stewart | |
| 2004/0107529 | A1 | | 6/2004 | Shahbaz | |
| 2006/0282964 | A1 | | 12/2006 | Sclafani et al. | |

FOREIGN PATENT DOCUMENTS

| | | | | |
|---|---|---|---|---|
| CN | 201510245 | U | | 6/2010 |
| EP | 1857031 | A1 | | 11/2007 |
| GB | 0699277 | A | * | 10/1951 |
| GB | 699 277 | A | | 11/1953 |
| WO | WO 2006/128534 | | | 12/2006 |

OTHER PUBLICATIONS

A Sucky Broom [online]. [retrieved on Jan. 6, 2009]. Retrieved from the Internet: <URL: http://www.yankodesign.com/2007/12/10/to-vacuum-or-broom/>.

Dirt Devil Rechargeable Broom Vacuum [online]. [retrieved on Jan. 6, 2009]. Retrieved from the Internet: <URL: http://www.amazon.com/Dirt-Devil-BV2030SLV-Rechargeable-Vacuum/dp/B0009ROCSK/ref=sr_1_1?ie=UTF8&s=home-garden&qid=1231265491&sr=8-1>.

International Preliminary Report on Patentability PCT/US2009/031838 mailed Mar. 10, 2011.

* cited by examiner

CLEANING DEVICE

CROSS-REFERENCE TO RELATED APPLICATIONS

This application claims the priority benefit under 35 U.S.C. §119(e) of U.S. provisional patent application No. 61/092,237, filed Aug. 27, 2008, the entirety of which is hereby incorporated by reference. Each and every U.S. patent and patent application mentioned herein is expressly incorporated by reference in its entirety.

BACKGROUND

1. Field of Invention

The invention is related to cleaning devices and, more particularly, to a cleaning device that may allow a user to manually sweep a surface to be cleaned and also draw debris from the surface into an interior compartment by suction.

2. Related Art

Home and office cleaning can be an arduous daily task despite the staggering number of products available to help make the undertaking easier and more efficient. With regard to devices available for cleaning floor surfaces, some of the more common household devices include brooms, mops, electric dustpans, and vacuum cleaners (e.g., handheld or upright vacuums). Vacuum cleaners, for example, may be battery operated or may have a power supply cord. Battery operated vacuum systems, which may or may not be rechargeable, can allow a user to vacuum without worrying if there are electric outlets available around the area to be vacuumed.

Notwithstanding the wide variety of upright and handheld vacuum cleaners and electric dustpans available, improved cleaning devices are needed that are economical, practical, and easy for a user to operate.

SUMMARY

In an embodiment of the invention, a cleaning device is provided. The cleaning device may include a handle, an activation mechanism moveable between a first position and a second position by a user of the device, a hollow member having a suction opening at an end of the hollow member, an electrically powered motor configured to produce suction at the suction opening, and a bristle support member pivotable relative to the hollow member. The bristle support member may include a plurality of bristles attached thereto. The bristle support member may be operatively coupled to the activation mechanism. When the activation mechanism is in the first position, the bristle support member may be in a closed position adjacent to the suction opening of the hollow member and the plurality of bristles may be positioned to perform a sweeping function. When the activation mechanism is moved to the second position, the bristle support member may be pivoted away from the suction opening of the hollow member to an open position to provide access to the suction opening.

In an embodiment of the invention, the cleaning device may include a handle and an activation mechanism moveable between a first position and a second position by a user of the device. The cleaning device may also include a frame member, a hollow member moveably disposed relative to the frame member and having a suction opening defined at an end of the hollow member. An electrically powered motor may be configured to produce suction at the suction opening. One of the hollow member and the frame member may be connected to an end of the handle and the other of the hollow member and the frame member may be coupled to the activation mechanism. When the activation mechanism is in the first position, the hollow member may be in a retracted position relative to the frame member. When the activation mechanism is in the second position, the hollow member may be in an extended position relative to the frame member. The cleaning device may further include a bristle support member pivotably coupled to the hollow member and including a plurality of bristles attached thereto. When the activation mechanism is in the first position, the bristle support member may be in a closed position adjacent to the suction opening of the hollow member and the plurality of bristles may be positioned to perform a sweeping function. When the activation mechanism is moved to the second position, the bristle support member may be pivoted away from the suction opening of the hollow member to an open position to provide access to the suction opening.

In an embodiment of the invention, a cleaning device is provided including means for sweeping debris on a surface, means for producing suction to remove debris from the surface, means for receiving and holding debris removed from the surface, means for pivoting at least a portion of the sweeping means relative to the receiving and holding means to allow the suction producing means to remove debris from the surface, and means for activating the pivoting means and the suction producing means.

Further features and advantages of the invention, as well as the structure and operation of various embodiments of the invention, are described in detail below with reference to the accompanying drawings. This summary is provided merely to introduce certain concepts and not to identify any key or essential features of the claimed subject matter.

BRIEF DESCRIPTION OF THE DRAWINGS

The foregoing and other features and advantages of the invention will be apparent from the following, more particular description of embodiments of the invention, as illustrated in the accompanying drawings wherein like reference numbers generally indicate identical, functionally similar, and/or structurally similar elements. Unless otherwise indicated, the accompanying drawing figures are not to scale.

DETAILED DESCRIPTION

Figure 1:
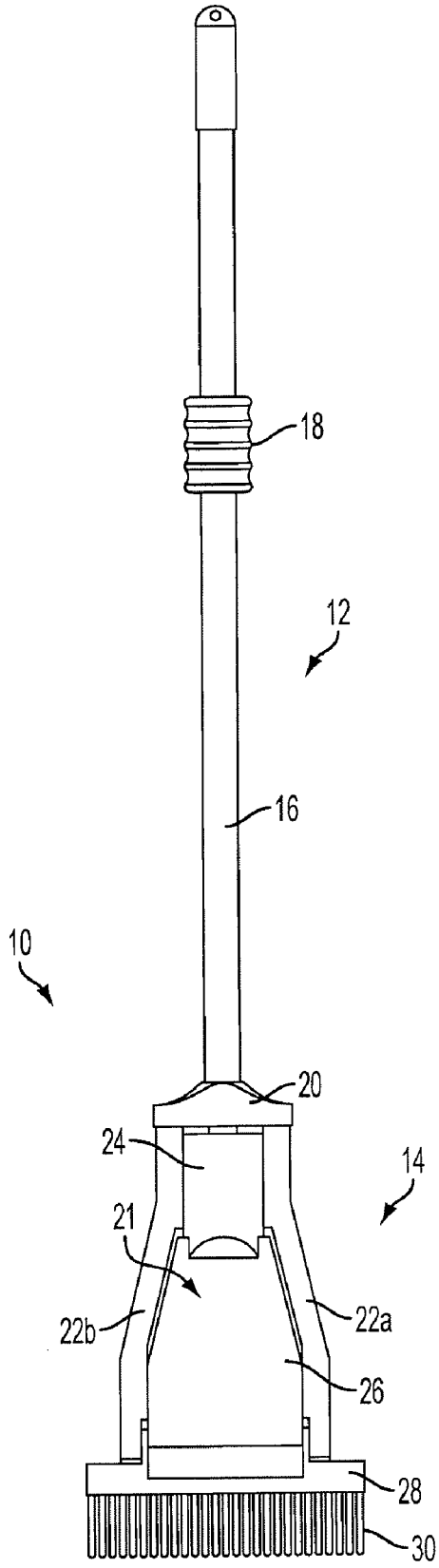
FIG. 1 depicts a front view of a cleaning device in a "sweeping mode" according to an embodiment of the invention.

Various embodiments of the invention are discussed herein. While specific embodiments are discussed, specific terminology is employed for the sake of clarity. However, the invention is not intended to be limited to the specific terminology so selected and it should be understood that this is done for illustration purposes only. A person skilled in the relevant art will recognize that other components and configurations can be used without parting from the spirit and scope of the invention. Each specific element includes all technical equivalents that operate in a similar manner to accomplish a similar purpose.

In the following description of some embodiments of the invention, directional words such as, for example, "top," "bottom," "left," "right," "upwardly," and "downwardly," "clockwise," "counter-clockwise," are employed by way of description and not limitation with respect to the orientation of the device and its various components as illustrated in the drawings.

Figure 2:
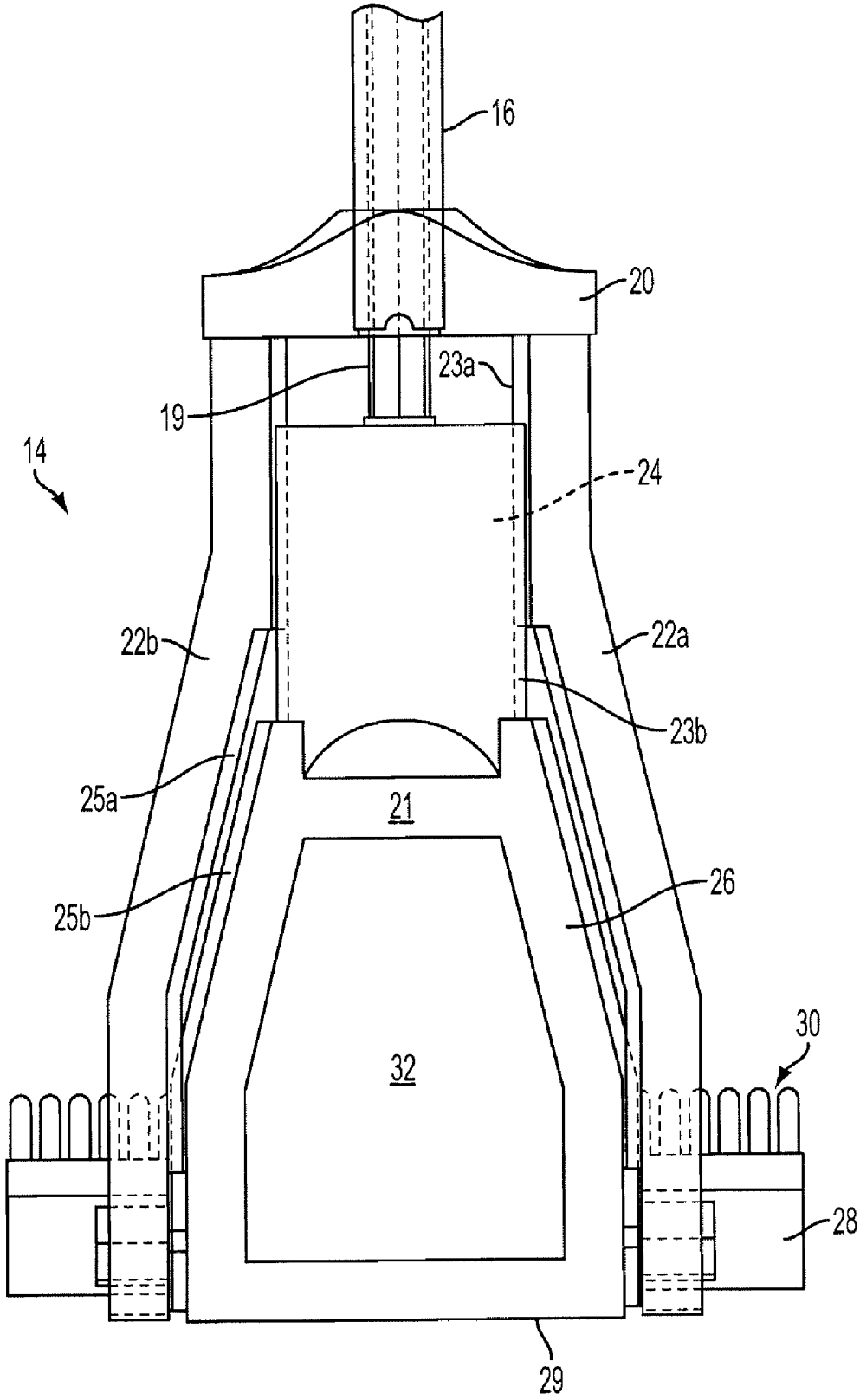
FIG. 2 depicts a partial front view of the cleaning device of FIG. 1 in a "suction mode"

FIG. 1 depicts a front view of a cleaning device 10 in a "sweeping mode" according to an embodiment of the invention. The cleaning device 10 may include, for example, a handle portion 12, and a base portion 14 and may be constructed to perform at least two functions, e.g., sweeping and suction (debris removal). FIG. 2, for example, depicts a partial front view of the cleaning device 10 in a "suction mode."

As shown in FIG. 1, the handle portion 12 may include a handle 16 defined, for example, by an elongated hollow tube which may be held or gripped by a user (not shown). The handle portion 12 may include an activation mechanism comprised of, for example, but not limited to, a grippable sleeve 18 and an elongated rod 19 (see FIG. 2). The grippable sleeve 18 of the activation mechanism may be moveably disposed about the handle 16 and may be manually moved by a user between a first position and a second position. Other equivalent mechanical structures such as, for example, a lever or any type of sliding or twisting grippable protrusion may be used in place of the sleeve 18. The grippable sleeve 18 is discussed in further detail below with reference to FIG. 6. The elongated rod 19 (see FIGS. 2 and 6) may be coupled to the grippable sleeve 18 and may extend within the hollow tube of the handle 16 toward the base portion 14.

The base portion 14 may include a frame member 20 having, for example, a pair of downwardly extending legs 22*a*, 22*b*. An inner housing or hollow member 21, defined by an upper portion 24 and a lower portion 26, may be moveably or slidably disposed between the legs 22*a*, 22*b*. A bristle support member 28 having bristles 30 may be pivotably mounted on the legs 22*a*, 22*b* of the frame member 20 and/or on the lower portion 26 of the hollow member 21. As one of ordinary skill will recognize, a user of the cleaning device 10 shown in FIG. 1 may use the device to sweep a surface.

FIG. 2 depicts an enlarged partial front view of the base portion 14 of the cleaning device 10 in the "suction mode" according to an embodiment of the invention. As shown in FIG. 2, the handle 16 may be rigidly coupled to the frame member 20 at C by a permanent connection (e.g., adhesive, welded, integral molding, etc.) or by a removeable connection (e.g., threaded, snap-fit, bayonet, fastener(s), set screw, etc.). The elongated rod 19 of the activation mechanism may extend freely through the handle 16 and the frame member 20 and may be coupled to the upper portion 24 of the hollow member 21. The hollow member 21 may be slidably disposed between the downwardly extending legs 22*a*, 22*b* of the frame member 20. As shown in FIG. 2, the legs 22*a*, 22*b* of the frame member 20 may include one or more first engaging elements 23*a*, 25*a* which may be engaged by one or more second engaging elements 23*b*, 25*b* on the hollow member 21. When cleaning device 10 is in the "suction mode" depicted in FIG. 2, hollow member 21 may be in a downwardly extended position and the bristle support member 28 with bristles 30 may be in a pivoted position (i.e., rearwardly into the page), thereby exposing a bottom surface 29 of the lower portion 26 of the hollow member 21. A door or panel 32 for accessing an interior compartment of the lower portion 26 of the hollow member 21 can also be seen.

Figure 3:
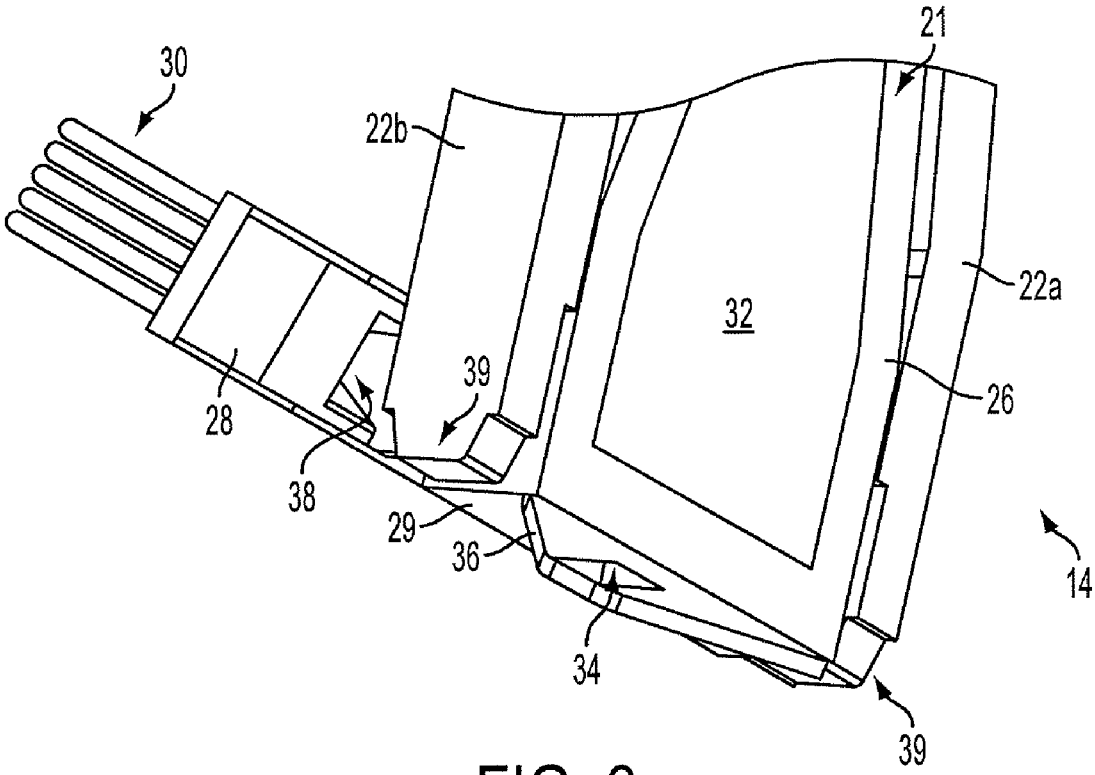
FIG. 3 depicts a partial perspective view of the cleaning device of FIGS. 1 and 2 in "suction mode"

FIG. 3 depicts a partial perspective view of the base portion 14 of the cleaning device 10 in "suction mode" with hollow member 21 in an extended position and bristle support member 28 with bristles 30 pivoted away from and exposing the bottom surface 29 of the lower portion 26 of the hollow member 21. A suction opening 34 may be defined in the bottom surface 29 of the lower portion 26 of the hollow member 21 and may allow debris disposed on a surface being cleaned to be removed from the surface and drawn into the interior of the hollow member lower portion 26 by a suction (vacuum) device (e.g., an electric motor) disposed, for example, in the hollow member upper portion 24 (see FIGS. 4 and 5). The bottom surface 29 of the hollow member lower portion 26 may also include a wall member 36 which may be tapered to assist in guiding the debris disposed on the surface toward the suction opening 34. The wall member 36 may be made of flexible or rigid material such as, for example, plastic, rubber, foam, or a number of small bristles, and may be separately manufactured and secured to the bottom surface 29 or integrally molded thereon. Also shown in the embodiment depicted in FIG. 3, the bristle support member 28 may include a tapered recess 38 in a top surface thereof for receiving tapered projections 39 at the ends of the legs 22*a*, 22*b* when the cleaning device is returned to "sweeping mode." This may provide support and stabilization during sweeping.

Figure 4:
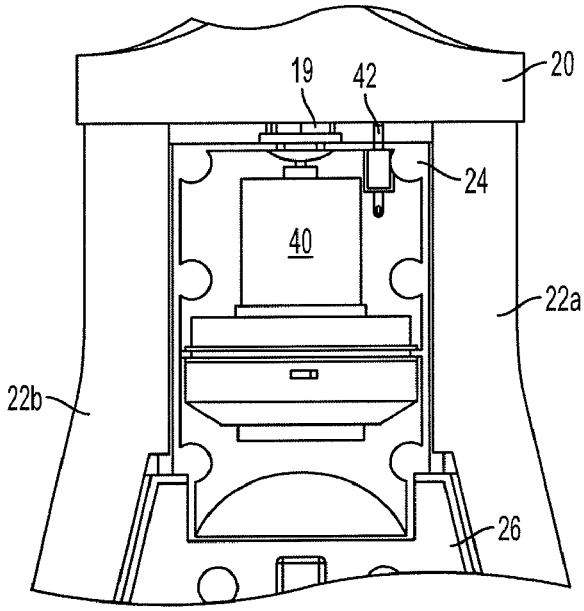
FIG. 4 depicts a partial front view of the cleaning device of FIGS. 1-3 in "sweeping mode" and showing a suction motor and a switch for powering the motor on and off.
Figure 5:
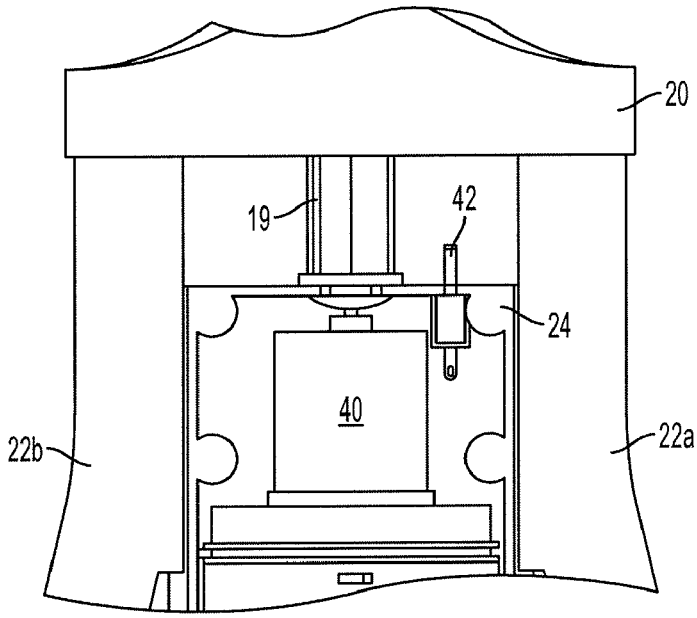
FIG. 5 depicts a partial front view of the cleaning device of FIGS. 1-4 in "suction mode" and showing the suction motor and switch for powering the motor on and off.

FIGS. 4 and 5 depicts a partial front view of the cleaning device 10 in "sweeping mode" and "suction mode," respectively. According to FIG. 4, the elongated member 19 of the activation mechanism may be connected to the hollow member upper portion 24. The hollow member upper portion 24 may include a suction motor 40 and a switch 42 (e.g., a microswitch) for powering the motor 40 on and off. In the "sweeping mode" (FIG. 4), the hollow member upper portion 24 may be disposed in a first position wherein the switch 42 is depressed against a bottom surface of the frame member 20 such that the motor 40 is off. In the "suction mode" (FIG. 5), the hollow member upper portion 24 may be moved to a second position away from the frame member 20 such that the switch 42 is released and the motor 40 is turned on to create suction within the hollow member lower portion 26.

Figure 6:
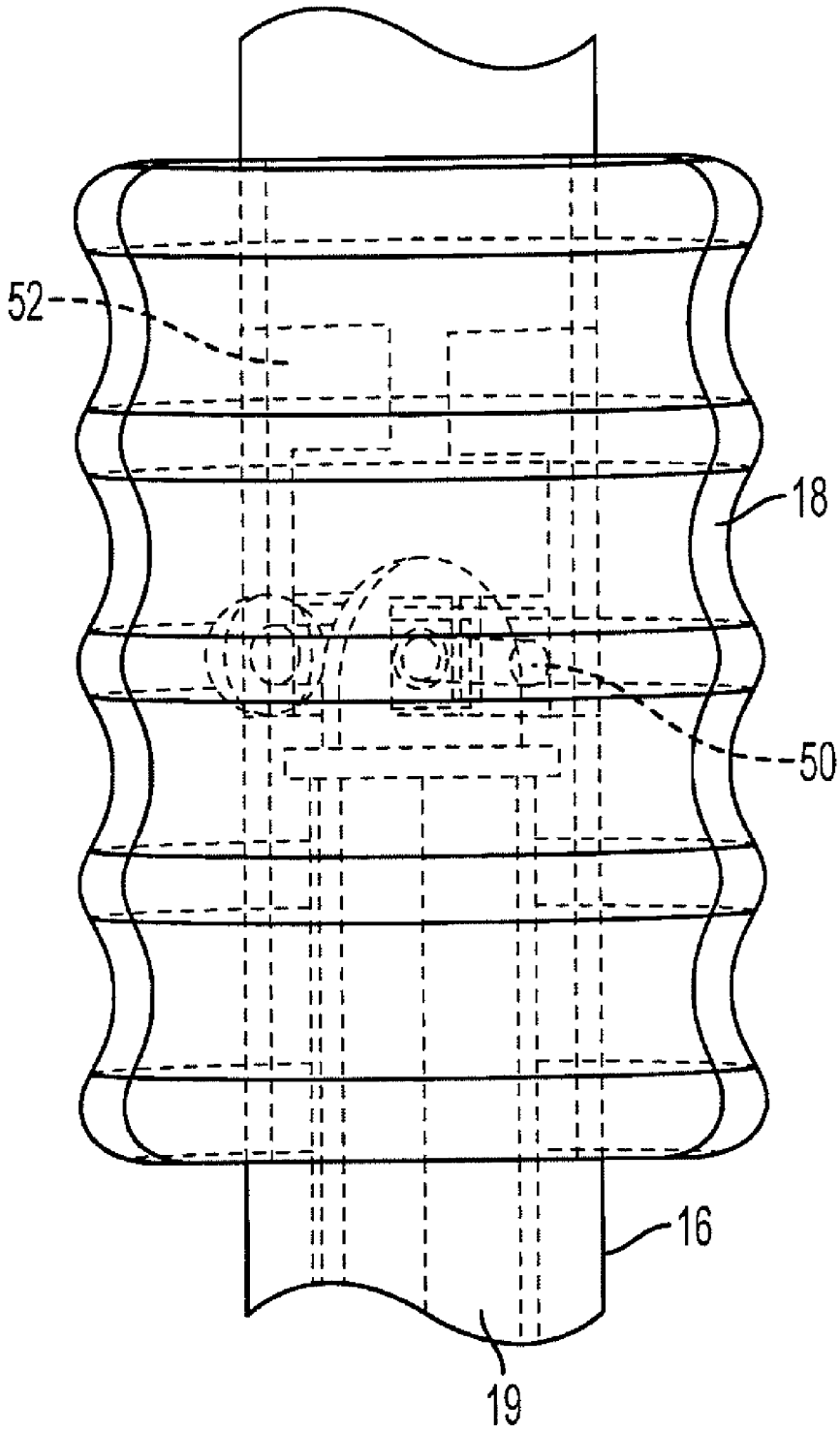
FIG. 6 depicts a partial side view of a grippable sleeve of an activation mechanism on a handle of the cleaning device of FIG. 1.

FIG. 6 depicts a partial side view of a grippable sleeve 18 of an activation mechanism on a handle 16 of the cleaning device 10 of FIG. 1. As shown in the embodiment depicted in FIG. 6, the grippable sleeve 18 may include an outer gripping portion and an inner annular portion slidably disposed about handle 16. The sleeve 18 may include a connection member in the form of a post 50 which may extend transversely through a slot 52 in the handle 16 to define a bayonet-like connection and which may be coupled to an end of the elongated rod 19. The slot 52 may be defined on each side of the handle 16 and may form, for example, a C-shape or a reverse C-shape. In operation, the sleeve 18 may be gripped by a user (not shown) and from a first position may be rotated in a first direction, moved longitudinally along the handle 16, and then rotated in a second direction opposite the first direction to secure the sleeve 18 in a second position (see also FIGS. 18*a* and 18*b*).

Figure 7:
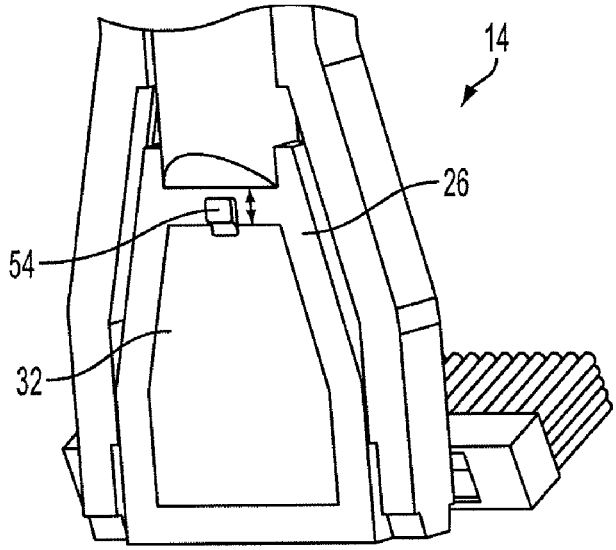
FIGS. 7 and 8 depict partial perspective views of the cleaning device of FIGS. 1 and 2 including a hollow member having a latched and hinged dust cup door.
Figure 8:
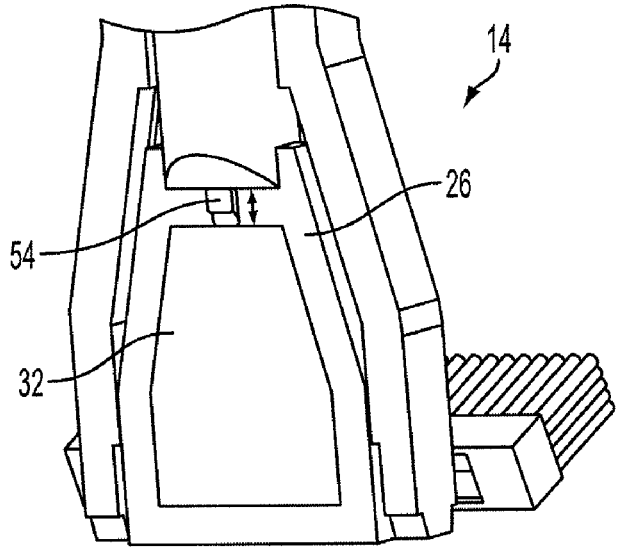
Figure 9:
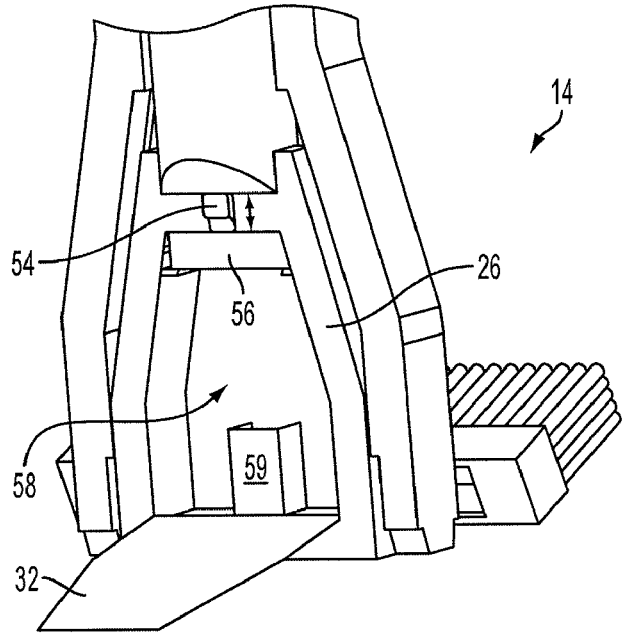
FIGS. 9 and 10 depict partial perspective views of the cleaning device of FIG. 7 with the latched and hinged dust cup door open to show the interior dust cup compartment of the hollow member.
Figure 10:
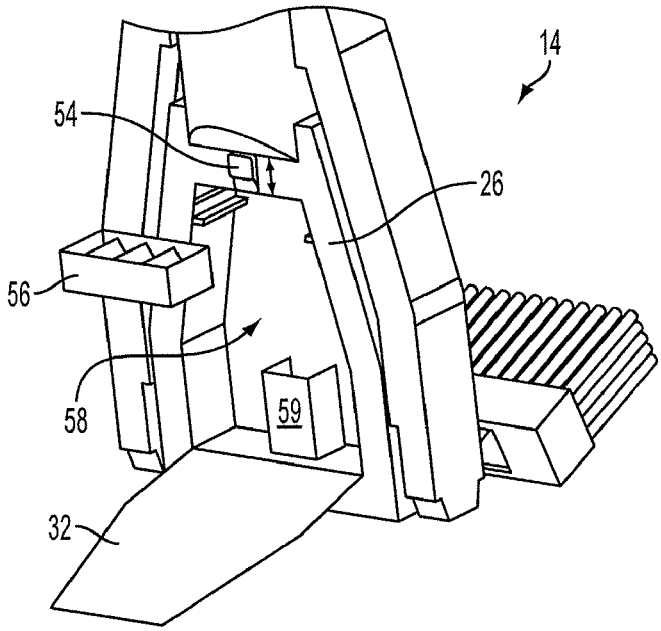

FIGS. 7 and 8 depict partial perspective views of the cleaning device 10 of FIGS. 1 and 2. In FIGS. 7 and 8, the hollow member lower portion 26 of the base portion 14 may include a dust cup door 32 which may be hingedly or removeably coupled to the lower portion 26. A slidable latch 54, for example, may be utilized to secure the dust cup door 32 in place. When the latch 54 is moved upward, for example, as shown in FIGS. 9 and 10, the dust cup door 32 may be opened to provide access to the hollow interior 58 of the hollow member lower portion 26. As shown in FIGS. 9 and 10, a filter device 56 may be removeably disposed at a top of the hollow interior 58 to prevent dust and debris drawn in through channel 59 from entering the suction motor 40 (not shown—see FIGS. 4 and 5).

Figure 11:
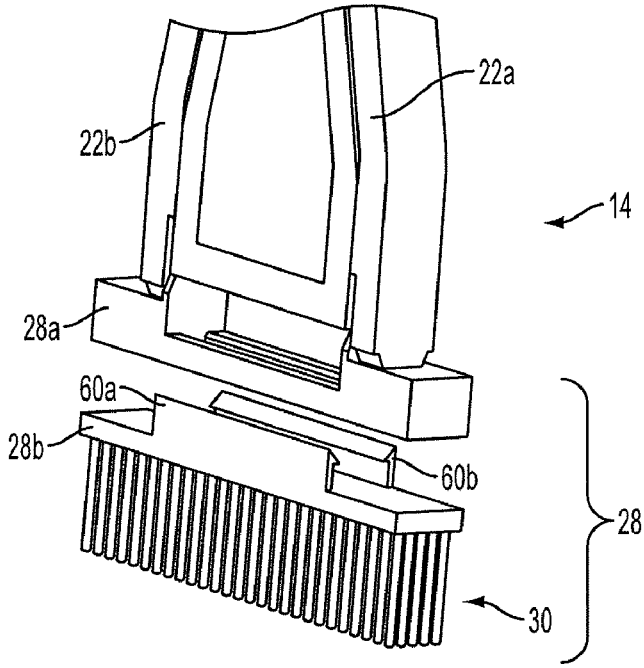
FIG. 11 depicts a partial perspective view of a cleaning device in "sweeping mode" according to an embodiment of the invention showing a detachable base member detached from a pivotable bristle support member, the base member having bristles attached thereto.
Figure 12:
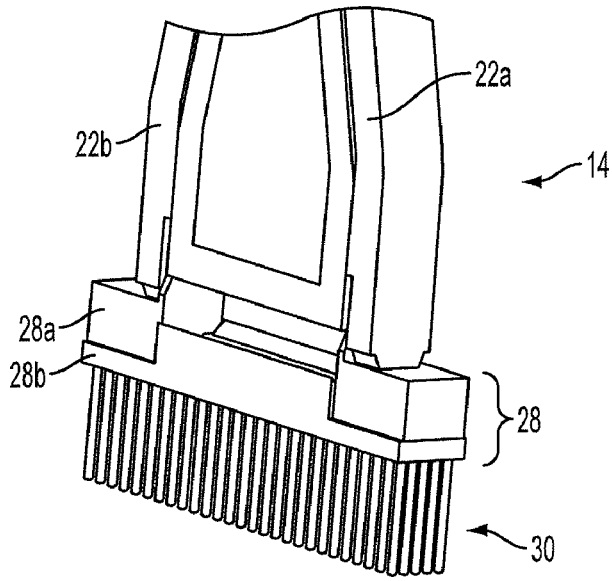
FIG. 12 depicts a partial perspective view of the cleaning device of FIG. 11 in "sweeping mode" and showing the detachable base member attached to the pivotable bristle support member.

FIGS. 11 and 12 depicts a partial perspective view of the base portion 14 of cleaning device 10 in "sweeping mode" according to another embodiment of the invention. As shown in FIGS. 11 and 12, the pivotable bristle support member 28 may include two portions, a pivoting support portion 28*a* and a detachable base member 28*b* having bristles 30. In FIG. 11, the detachable base member 28*b* is shown detached from the pivoting support portion 28*a*. The detachable base member 28*b* may include attachment members 60*a*, 60*b*, which may be configured to allow a snap-fit connection with the pivoting support portion 28*a*. Other mechanisms for detachably securing the detachable base member 28*b* to the pivoting support portion 28*a* may include, for example, fasteners, latches, detent mechanisms, tongue-in-groove connections, dovetail connections, and other equivalent as one of ordinary skill in the art will recognize. A number of detachable base members 28*b* may be provided for connection to the pivoting support portion 28*a*, each having different bristle structures 30 for different sweeping jobs. Different base members 28*b* may have longer bristles, shorter bristles, bristles of differing stiffness and material, and/or differing numbers and types of bristles depending on the job to be undertaken.

Figure 13:
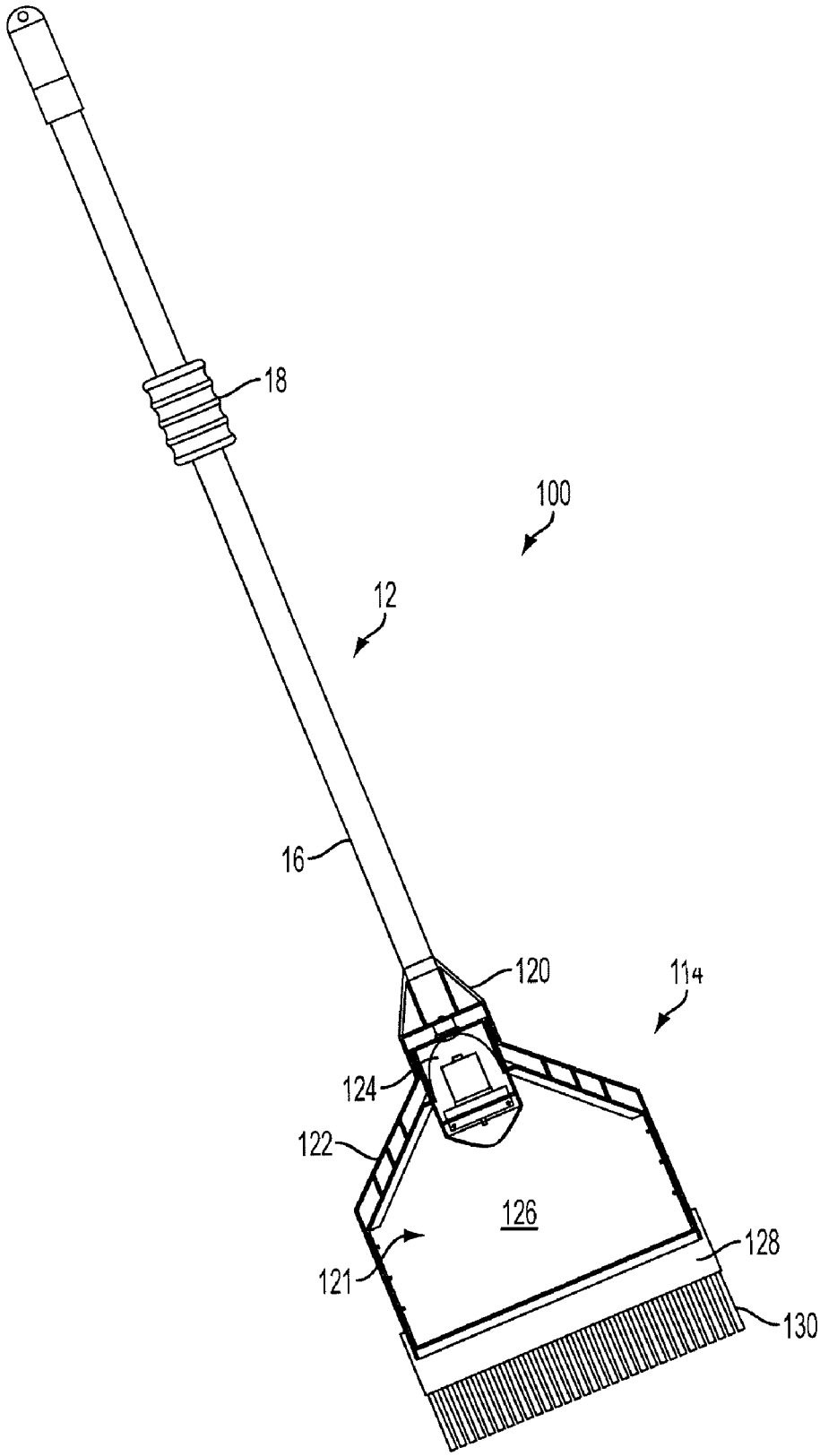
FIG. 13 depicts a front view of a cleaning device in a "sweeping mode" according to another embodiment of the invention.

FIG. 13 depicts a front view of a cleaning device 100 in a "sweeping mode" according to another embodiment of the invention. The handle portion 12 of cleaning device 100 is substantially similar to the handle portion 12 of the cleaning device 10 discussed above with reference to FIGS. 1-12 and so will not be further discussed in detail. The handle 16 may be connected to a base portion 114. The base portion 114 may include a frame member 120 having an outer housing 122. An inner housing or hollow member 121 may include an upper portion 124 and a lower portion 126. The upper portion 124 of the hollow member 121 may be coupled to the elongated rod 19 (see FIG. 14) and the hollow member 121 may be moveably disposed within the outer housing 122 such that movement of the grippable sleeve 18 of the activation mechanism may cause relative movement between the hollow member 121 and the frame member 120. A bristle support member 128 having bristles 130 may be pivotably coupled to one or both of the outer housing 122 and/or the hollow member 121 such that relative movement between the hollow member 121 and the outer housing 122 causes the bristle support member 128 to pivot between a first position in the "sweeping mode" and a second position in the "suction mode."

Figure 14:
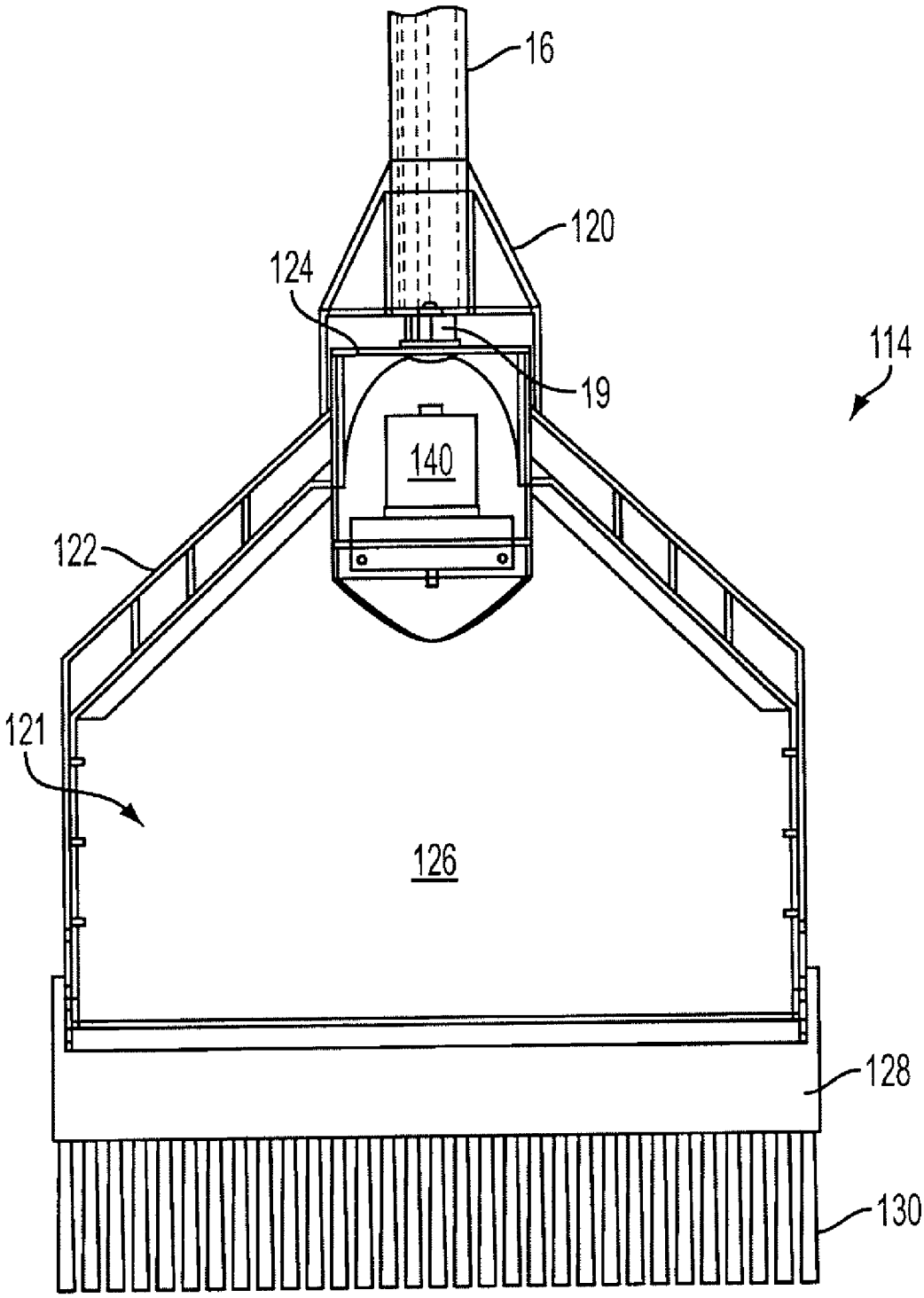
FIG. 14 depicts a partial front view of the cleaning device of FIG. 13 in the "sweeping mode"

FIG. 14 depicts a partial front view of the base portion 114 of the cleaning device 100 of FIG. 13 in the "sweeping mode." As shown in FIG. 14, the elongated rod 19 of the activation mechanism may extend through the hollow interior of the handle 16, into the frame member 120, and may be coupled at an end to the upper portion 124 of the hollow member 121. An electrically powered (e.g., battery powered) suction motor 140 may be disposed within the upper portion 124 of the hollow member 121 and may be configured to be powered on and off based on relative movement between the hollow member 121 and the frame member 120 due to user operation of the activation mechanism.

Figure 15:
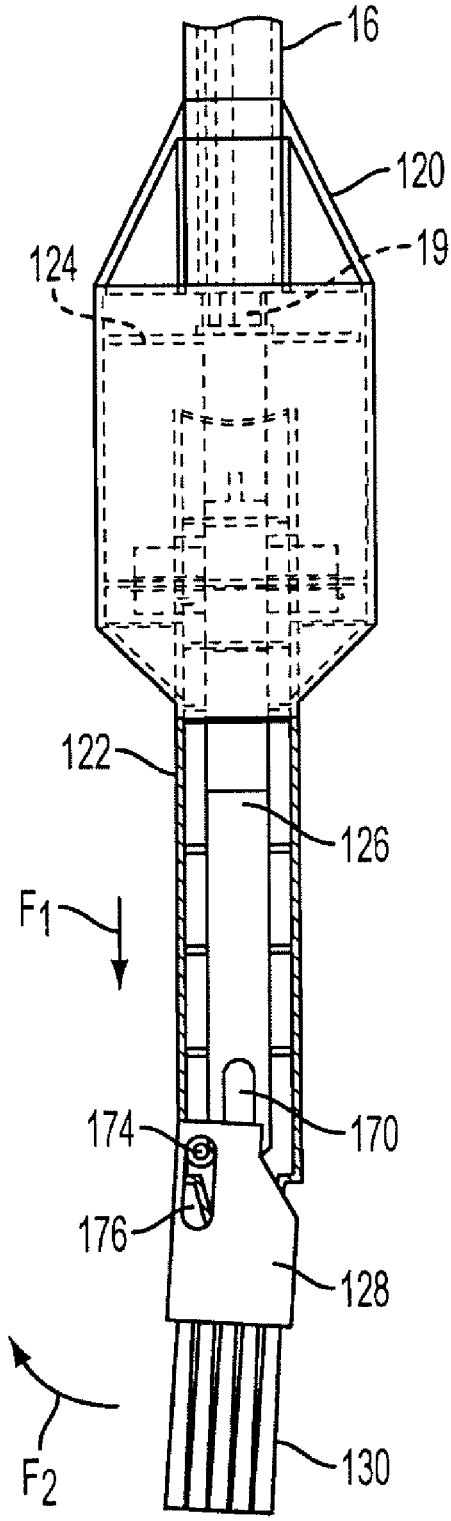
FIG. 15 depicts a partial cross-sectional side view of the cleaning device of FIG. 13 in the "sweeping mode"

FIG. 15 depicts a partial cross-sectional side view of the base portion 114 of the cleaning device 100 of FIG. 13 during a transition between the "sweeping mode" and the "suction mode." For example, in FIG. 15 as a user operates the activation mechanism and moves the elongated rod 19 and hollow member 121 (including upper and lower portions 124, 126) from a first position ("sweeping mode") to a second position ("suction mode") in a direction $F_1$, a mechanical arrangement may cause the bristle support member 128 to pivot away from a bottom of the hollow member 121 and outer housing 122 along direction $F_2$. The mechanical arrangement may include, for example, but not limited to, a slot 170 in a side of the outer housing 122 which may slidably receive a pin 172 (see FIGS. 16-17) coupling the hollow member lower portion 126 to the bristle support member 128. A pin 174 may be disposed on the side of the outer housing 122 at a position offset from the slot 170. The pin 174 may be slidably received in a slot 176 defined in a wall of the bristle support member 128 at a position offset from the pin 172.

Figure 16:
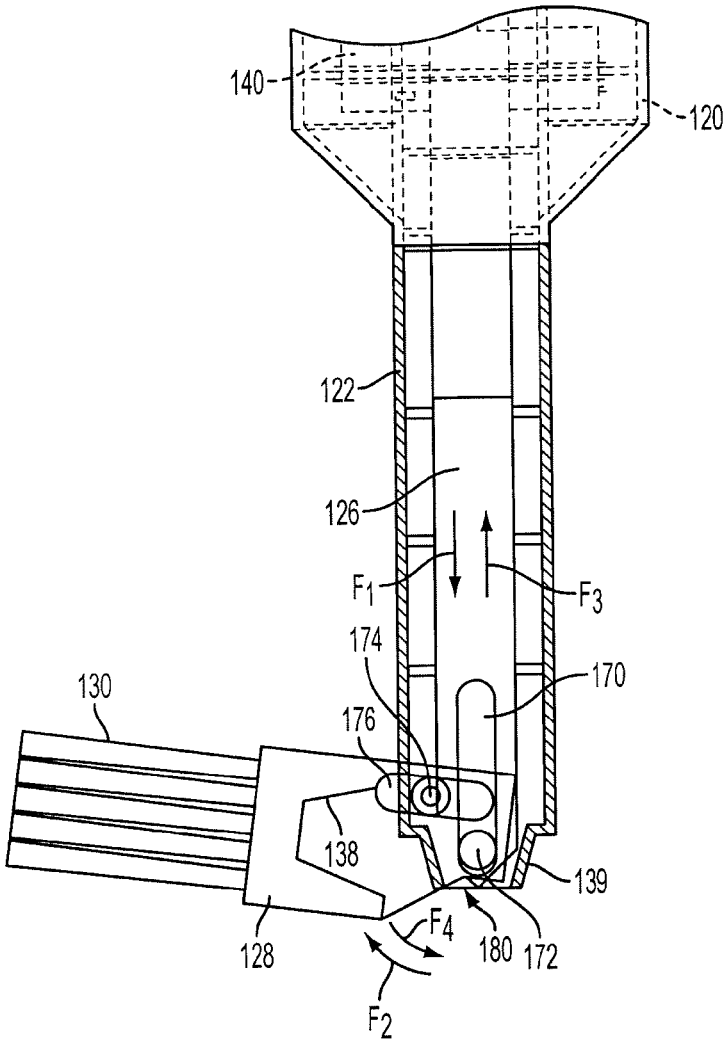
FIG. 16 depicts a partial cross-sectional side view of the cleaning device of FIGS. 13-15 in the "suction mode"
Figure 17:
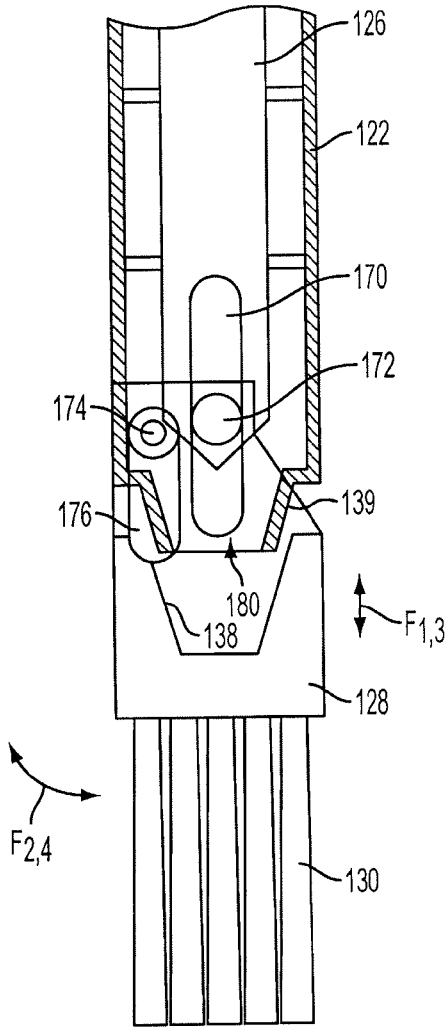
FIG. 17 depicts a partial cross-sectional side view of the cleaning device of FIGS. 13-16 in transition between "suction mode" and "sweeping mode"

FIGS. 16 and 17 depicts partial cross-sectional side views of the base portion 114 of the cleaning device 100 of FIGS. 13-15, showing the transition between the "sweeping mode" and the "suction mode." In operation, as the hollow member lower portion 126 is moved in direction $F_1$ by the activation mechanism (not shown), pin 172 on the hollow member lower portion 126 slides downward within the slot 170 of the outer housing 122. At the same time, the slot 176 on the bristle support member 128 moves relative to the pin 174 until the pin 174 reaches an upper end of the slot 176. Continued movement of the pin 172 in direction $F_1$ initiates rotation of the bristle support member about pin 172 in direction $F_2$. During rotation of support member 128, pin 174 slides within slot 176. The suction motor 140 may be turned on when hollow member lower portion 126 is extended to its downwardmost position (e.g., when pin 172 reaches a lowermost end of slot 170) and support member 128 is pivoted to a rotational endpoint along direction $F_2$. With suction motor 140 on, dust and other debris can be removed from the surface to be cleaned by suction through an opening 180 at the bottom of the outer housing 122 and hollow member lower portion 126. The cleaning device 100 may be returned to the "sweeping mode" by moving the hollow member lower portion 126 in direction $F_3$ with the activation mechanism. Movement of the hollow member lower portion 126 in direction $F_3$ causes the bristle support member 128 to pivot back to its original position covering opening 180. A bottom portion 139 of the outer housing 122 may be tapered and may be received in a tapered recess 138 defined in a top surface of the bristle support member 128.

Figure 18A:
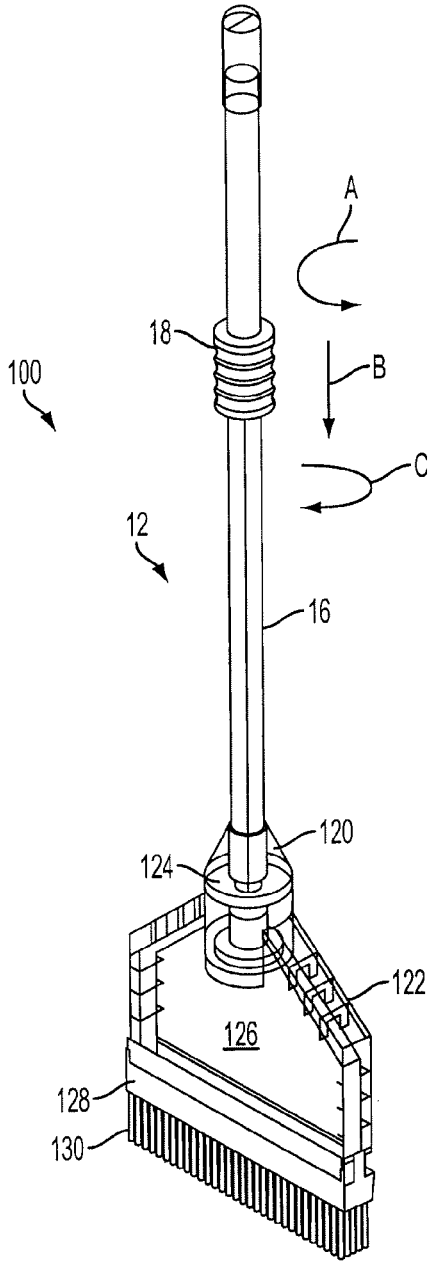
FIGS. 18*a* and 18*b* depict perspective views of the cleaning device of FIG. 13 in the "sweeping mode" and the "suction mode," respectively, as well as an illustration of the movement of a grippable sleeve of an activation mechanism to effect the transition from one mode to the other.
Figure 18B:
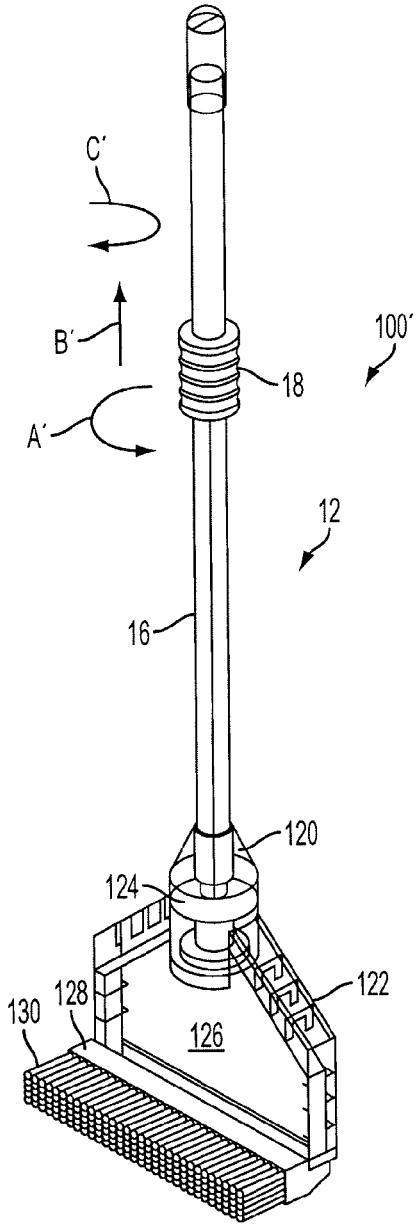

FIGS. 18*a* and 18*b* depict perspective views of the cleaning device of FIG. 13 in the "sweeping mode" (100) and the "suction mode" (100') respectively. Also depicted in FIGS. 18*a* and 18*b* is an example movement of the grippable sleeve 18 of the activation mechanism to effect the transition from one mode to the other. In FIG. 18*a*, for example, the cleaning device 100 is shown in the "sweeping mode." In "sweeping mode," the sleeve 18 may be in a first position and the hollow member upper and lower portions 124, 126 may be in a retracted position relative to a bottom of the outer housing 122. The motor 140 may be "off" and the bristle support member 128 may be substantially aligned with the longitudinal extension of the cleaning device 100 such that a user can utilize the device 100 to sweep a floor or surface in a conventional manner. Once sweeping is completed and/or suction (debris removal) is required, the user may operate the activation mechanism to transition to cleaning device 100' in "suction mode" (see FIG. 18*b*).

In order to transition the cleaning device 100 to "suction mode," a user may grip the sleeve 18 and move the sleeve 18 in accordance with the sequential movements (A, B, C) shown in FIG. 18*a*. First, the sleeve 18 may be twisted in direction A from a first locked position. Second, the sleeve 18 may be moved longitudinally downward along handle 16 in direction B. Third, the sleeve 18 may be twisted in direction C (opposite direction A) to lock the sleeve 18 in a second position. When sleeve 18 is in the second position, the cleaning device 100' may be in "suction mode." When the cleaning device 100' is in "suction mode" as shown, for example, in FIG. 18*b*, the hollow member upper and lower portions 124, 126 may be in an extended position relative to a bottom of the outer housing 122. The motor 140 may be "on" and the bristle support member 128 may be pivoted away from the bottom of the outer housing 122 to an offset position such that a user can utilize the device 100' to suck up or remove debris from a floor or surface. In order to transition the cleaning device 100' from "suction mode" back to "sweeping mode," a user may again grip the sleeve 18 and move the sleeve 18 in accordance with the sequential movements (A', B', C') shown in FIG. 18*b*. First, the sleeve 18 may be twisted in direction A' from the second locked position. Second, the sleeve 18 may be moved longitudinally upward along handle 16 in direction B'. Third, the sleeve 18 may be twisted in direction C' (opposite direction A') to lock the sleeve 18 in the first position.

While various embodiments of the present invention have been described herein, it should be understood that they have been presented by way of example only, and not limitation. Thus, the breadth and scope of the present invention should not be limited by any of the described embodiments, but should instead be defined only in accordance with the following claims and their equivalents.

The invention claimed is:

1. A cleaning device comprising:

a handle;

an activation mechanism moveable between a first position and a second position by a user of the device;

a hollow member moveably disposed relative to the frame member and comprising a suction opening at an end of the hollow member;

an electrically powered motor configured to produce suction at the suction opening, wherein the frame member is connected to an end of the handle and the hollow member is coupled to the activation mechanism, whereby when the activation mechanism is in the first position, the hollow member is in a retracted position relative to the frame member, and whereby when the activation mechanism is in the second position, the hollow member is in an extended position relative to the frame member, a linking member movable relative to the handle and having a first and second end, the first end coupled to the activation mechanism and the second end fixedly connected to the hollow member; and a bristle support member pivotable relative to the hollow member and including a plurality of bristles attached thereto, wherein the bristle support member is operatively coupled to the activation mechanism, whereby when the activation mechanism is in the first position, the bristle support member is in a closed position closing the suction opening of the hollow member and the plurality of bristles are positioned to perform a sweeping function, and wherein when the activation mechanism is moved to the second position, the bristle support member pivots away from the suction opening of the hollow member to an open position to provide access to the suction opening.

2. The cleaning device according to claim 1, wherein the handle comprises a hollow shaft and the linking member comprises a rigid shaft moveably disposed within the handle.

3. The cleaning device according to claim 2, wherein the activation mechanism comprises a grippable sleeve slidably and rotatably disposed on the handle by a bayonet connection.

4. The cleaning device according to claim 3, wherein the grippable sleeve is connected to the linking member through a slot in the handle, and wherein the grippable sleeve can be locked in the first and second positions.

5. The cleaning device according to claim 4, wherein the grippable sleeve is moveable from the first position to the second position by rotating the sleeve in a first direction, sliding the sleeve linearly toward or away from the frame member, and rotating the sleeve in a second direction opposite the first direction.

6. The cleaning device according to claim 1, wherein movement of the hollow member relative to the frame member causes the bristle support member to pivot between the closed position and the open position.

7. The cleaning device according to claim 1, further comprising a switch disposed on the hollow member to turn the motor on and off as the hollow member and the frame member move relative to one another, wherein when the activation mechanism is in the first position and the hollow member is in the retracted position relative to the frame member, the motor is off, and wherein when the activation mechanism is moved to the second position and the bristle support member moves to the open position, the motor turns on automatically.

8. The cleaning device according to claim 1, wherein the frame member comprises a housing and the bristle support member is pivotably coupled to the hollow member by first pins extending through a first linear slot on each side of the housing, and wherein the bristle support member includes a second linear slot offset from the first pins which receives second pins disposed on each side of the housing, whereby when the hollow member moves from the retracted position to the extended position, the bristle support member pivots about the first pins as the second pins slide within the second linear slot.

9. The cleaning device according to claim 1, further comprising a detachable base member removably mounted on the bristle support member, wherein the detachable base member comprises a body to which the plurality of bristles are permanently attached.

10. The cleaning device according to claim 9, further comprising an additional detachable base member configured to be removably mounted on the bristle support member and including a body to which a plurality of additional bristles are permanently attached, wherein the additional detachable base member is configured to replace the detachable base member, and wherein the plurality of additional bristles differ structurally from the plurality of bristles.

11. The cleaning device according to claim 1, wherein the hollow member defines an interior compartment configured to contain debris suctioned through the suction opening by the motor, and wherein a wall of the hollow member comprises a hinged panel to provide access to the interior compartment.

12. The cleaning device according to claim 11, further comprising a removable filter element disposed within the interior compartment.

13. The cleaning device according to claim 1, wherein the activation mechanism is disposed on the handle.

14. The cleaning device according to claim 1, wherein the activation mechanism comprises a grippable sleeve slidably and rotatably disposed on the handle by a bayonet connection.

15. The cleaning device according to claim 1, further comprising a strip of flexible material attached to a wall of the hollow member adjacent to the suction opening, wherein the strip of flexible material is shaped to guide debris on a surface to be cleaned toward the suction opening.

16. A cleaning device comprising:

a handle;

an activation mechanism moveable between a first position and a second position by a user of the device;

a frame member;

a hollow member moveably disposed relative to the frame member and comprising a suction opening defined at an end of the hollow member;

an electrically powered motor configured to produce suction at the suction opening, wherein the frame member is connected to an end of the handle and the hollow member is coupled to the activation mechanism, whereby when the activation mechanism is in the first position, the hollow member is in a retracted position relative to the frame member, and whereby when the activation mechanism is in the second position, the hollow member is in an extended position relative to the frame member, a linking member movable relative to the handle and having a first and second end, the first end coupled to the activation mechanism and the second end fixedly connected to the hollow member; and a bristle support member pivotably coupled to the hollow member and including a plurality of bristles attached thereto, wherein when the activation mechanism is in the first position, the bristle support member is in a closed position closing the suction opening of the hollow member and the plurality of bristles are positioned to perform a sweeping function, and wherein when the activation mechanism is moved to the second position, the bristle support member pivots away from the suction opening of the hollow member to an open position to provide access to the suction opening.

* * * * *